United States Patent [19]

Gunther

[11] Patent Number: 4,860,836

[45] Date of Patent: Aug. 29, 1989

[54] METHOD AND APPARATUS FOR INDICATING SAMPLE COLLECTION TIMES DURING WELL DRILLING

[76] Inventor: Larry J. Gunther, P.O. Box 100, Neola, Utah 84053

[21] Appl. No.: 226,808

[22] Filed: Aug. 1, 1988

[51] Int. Cl.[4] ..... E21B 44/00

[52] U.S. Cl. ..... 175/44; 175/48; 175/50; 73/153

[58] Field of Search ..... 175/40, 44, 50, 48; 73/153, 155

[56] References Cited

U.S. PATENT DOCUMENTS

| | | | |
|---|---|---|---|
| 3,982,432 | 9/1976 | Hammond | 73/155 |
| 4,393,485 | 7/1983 | Redden | 367/25 |
| 4,565,086 | 1/1986 | Orr, Jr. | 73/23 |
| 4,635,735 | 1/1987 | Crownover | 175/48 |
| 4,708,212 | 11/1987 | McAuley et al. | 175/48 |
| 4,739,655 | 4/1988 | Greer et al. | 73/155 |

OTHER PUBLICATIONS

Anadrill Schlumberger, The Advisor System brochure, 9/86.

Data sheets on Exploration Logging, Inc.'s EXLOG system, 1988.

*Primary Examiner*—Stephen J. Novosad
*Assistant Examiner*—Terry L. Melius
*Attorney, Agent, or Firm*—Mallinckrodt & Mallinckrodt

[57] ABSTRACT

A system for eliminating the need for one or more mud loggers on a drilling rig keeps track of the travel of drilling mud injected into the bottom of the well as it moves to the surface of the well with entrapped drill cuttings and gas so that for mud reaching the surface of the well, the system knows at what depth in the well the mud was injected. The system indicates to drill rig personnel when mud from preselected well depths reach the surface of the well and when to collect samples of drill cuttings strained from the mud in order to have the required samples representative of the preselected well depths. The system monitors the performance of well personnel in collecting samples by monitoring the time it takes to collect a sample after the indication that the sample should be collected. The system can also print labels to be attached to the collected samples to properly identify them and can also measure various properties of the mud reaching the surface and correlate such properties with the depth of the well from which the mud came.

22 Claims, 3 Drawing Sheets

SAMPLE COLLECTION TIMES

SAMPLE COLLECTION TIMES FROM 12510 TO 12600 FEET

JULY 05, 1988 - 21:05

| DEPTH | TIME OF DAY | COLLECTION TIME |
|---|---|---|
| | DATE: 7 - 5 | |
| 12,510 | 16:56 | 1:17 |
| 12,520 | 17:31 | 0:57 |
| 12,530 | 17:57 | 3:42 |
| 12,540 | 18:31 | MISSED |
| 12,550 | 18:56 | 0:57 |
| 12,560 | 19:30 | 1:23 |
| 12,570 | 20:10 | 1:21 |
| 12,580 | 20:43 | 0: 4 |
| 12,590 | 20:48 | 0:48 |
| 12,600 | 20:53 | 1:23 |

SAMPLE COLLECTION TIMES

SAMPLE COLLECTION TIMES FROM 12510 TO 12600 FEET
JULY 05, 1988 - 21:05

| DEPTH | TIME OF DAY | COLLECTION TIME |
|---|---|---|
| | DATE: 7 - 5 | |
| 12,510 | 16:56 | 1:17 |
| 12,520 | 17:31 | 0:57 |
| 12,530 | 17:57 | 3:42 |
| 12,540 | 18:31 | MISSED |
| 12,550 | 18:56 | 0:57 |
| 12,560 | 19:30 | 1:23 |
| 12,570 | 20:10 | 1:21 |
| 12,580 | 20:43 | 0: 4 |
| 12,590 | 20:48 | 0:48 |
| 12,600 | 20:53 | 1:23 |

METHOD AND APPARATUS FOR INDICATING SAMPLE COLLECTION TIMES DURING WELL DRILLING

BACKGROUND OF THE INVENTION

Field

The invention is in the field of mud logging, i.e., measuring and entering into an oil well log various measurements made concerning the oil well as it is being drilled, and the taking of drill cutting samples from desired well depths to provide information regarding the well.

State of the Art

It is common practice in oil well drilling operations to pump a drilling mud down through the drill stem and into the region around the drill bit during drilling. The mud then flows back up to the surface through the well bore outside the drill stem. The drilling mud is typically made up of clays and chemical additives in an oil or water base and performs several important functions. The drilling mud acts as a coolant and lubricates the drill bit during operation and it collects the drill cuttings and carries them back to the surface of the well. The drilling mud also serves to maintain a hydrostatic pressure to prevent pressurized gases from the earth from blowing out through the drilled well. In addition, the mud will pick up and entrain gases present in the bottom of the well and deliver them to the surface along with the drill cuttings.

It has been common in the past to provide a log of the drilling operation that will permit the nature of the earth formation through which the drill bit is penetrating to be analyzed. The log is important because it enables the drilling operator to ascertain the presence of oil or gas in the formation being drilled and also the location of such oil or gas in the well. As part of this logging operation, samples of the drill cuttings from predetermined depths of the well are collected and analyzed. Generally, these samples will be collected to represent a desired interval of drilling, such as every ten feet of well drilled or every thirty feet drilled.

The logging of a well, commonly called mud logging because the information recorded and drill cuttings collected and analyzed are obtained from the drilling mud reaching the surface of the well, is generally done on a manual basis by a person called a "mud logger." This person, usually with a background in geology, collects and analyzes the well drill cuttings obtained from the drilling mud, monitors the gases released from the drilling mud, and enters the information collected in a well log along with information concerning the depth of the well where the cuttings and gas originated. Thus, the mud logger keeps track of the depth of the well generally through the use of a depth measuring device on the drilling rig called a geolograph and, having an approximate idea of the lag time, i.e., the time it takes mud at the bottom of the well to reach the top of the well, gained through occassional rough measurements of the lag time, estimates the depth from which a mud sample reaching the surface originated. All of the measurements and the measuring equipment require constant supervision so a logging operation generally involves two mud loggers each working alternate twelve hour shifts.

Lag time, the time required for drill bit cuttings and drill bit liberated formation gas to reach the surface after being drilled is generally determined every few days or every several hundred feet of drilling by determining the amount of time required for a marker device, i.e., a small packet of carbide, multicolored rope, etc., to appear in the drilling fluid return line after being dropped into the drill pipe. This commonly used method is inaccurate in determining lag time because of the relative infrequency of the measurement and because a measurement based merely on time cannot accurately allow for changes in drilling fluid pump speed or for changing from one pump to another and the resulting change in pump output.

The measurement of lag is an important aspect in determining when samples of drill cuttings are to be collected for further examination. Samples, which comprise formation cuttings strained from the circulating drilling fluid as it reaches the surface of the well, are generally collected for microscopic examination at every ten feet or every thirty feet of well penetration. These samples are then representative of the drill cuttings produced through that ten foot or thirty foot interval. Sample collection times are generally determined by adding the lag time to the time when samples are drilled. Therefore, if a sample of drill cuttings from a well depth of 2500 feet has been collected and it is desired to collect samples at ten foot intervals, the next sample should be collected when mud from a depth of 2510 feet reaches the surface. The mud logger would determine when the well depth was 2510 feet, for example at 9:30 a.m., and then would add the lag time to determine when the sample should be collected. If the lag time had been determined by measurement to be one-half hour, the mud logger would add one-half hour to the 9:30 a.m. time and know that the next sample of drill cuttings should be collected at 10:00 a.m. and, if collected at that time, the drill cuttings should be those cut between the 2500 and the 2510 depth level of the well. However, if the lag time is not accurately determined and up dated, the samples collected are not representative of the desired depth. Further, merely adding the approximately determined lag time to the time the well reaches the desired depth does not allow for compensation necessary if, during that time, the drilling fluid pump speed changes, the pump used to pump the fluid changes, or the drilling rig temporarily stops drilling.

A further problem in collecting samples even where lag time can be fairly accurately determined is that a person must actually go to the area of the drilling rig where the mud is flowing from the well to collect the sample of drill cuttings and then properly package and label such sample for later evaluation. While a mud logger on duty can calculate the approximate time for collecting the sample, as indicated above, the logger's many other duties may interfer with his ability to keep track of the time a sample is due to be taken and thus interfer with timely sample collection. In many cases the collection of samples is left to drilling rig personnel. With logging units utilizing a single mud logger where the logging equipment is unattended at least twelve hours a day or with unmanned units where mud loggers only check the instruments periodically, the sample collection duties have to be left to drilling rig personnel. Drilling rig personnel have their own jobs to do and do not like collecting samples. Further, it is difficult for the rig personnel to keep track of the times when samples are to be collected and, since they are not involved in lag time calculations, generally base collection time on well depths and do not compensate for lag time. It is not uncommon to have several collection times passed up and then to have the large sample collected over the large depth interval divided and packaged to represent samples taken over various smaller depth intervals. If the sample interval is too large, the sample collecting container may have completely filled during the first part of the interval, so, rather than representing drill cuttings from the entire large interval, the sample may represent only a small portion, usually the inital portion, of the sample period. In either case, such samples do not provide a true picture of the characteristics of the well.

The current trend in oil well drilling is to provide automated equipment to take various oil well measurements. While various systems have been developed to automatically collect oil well data, many such systems are complicated and require a mud logger to operate them. Further, such systems do not automate the sample collection process so still require a mud logger to keep track of sample collection times and ensure that samples are properly collected. With increasing emphasis on controlling costs, many drilling rig operators would like to reduce the need for mud loggers or eliminate it completely. It would be advantageous to have a sample collection system that would alert well personnel when a sample should be collected and monitor whether or not the sample is collected and the amount of time elapsed from the indication that the sample should be collected to the time it is actually collected. With such a system, and with automated collection of other needed well data, it would be possible to eliminate the need for one or both of the usual mud loggers. It would also be advantageous if the system could more accurately keep track of lag time so that samples are more accurately collected.

SUMMARY OF THE INVENTION

According to the invention, a computer operated system which allows the elimination of one or both normally used mud loggers on a drilling rig continually monitors parameters necessary to determine the depth at which drilling mud reaching the surface of a well was injected into the well. Using this information, the system then indicates to well personnel, such as through an audible alarm, when samples of drill cuttings should be collected so that the samples will, to a significantly greater degree than previously possible, represent the drill cuttings originating from preselected desired depths. Additionally, the system may also measure predetermined properties of mud reaching the surface which relate to conditions at the depth the mud was injected into the well and then calculate the depth at which the measured mud was injected into the well. If desired, the system may then print a mud log which correlates the measurements from the mud with the calculated depth to which the measurements relate. The log can be printed in various formats and various measurements from the mud may be included. Generally, the measurements taken will include total gas content and constituent gas concentrations for the five gases usually measured, i.e., methane, ethane, propane, butane, and isobutane. These measurements may be taken at any desired intervals of well depth.

The system of the invention includes means for tracking the movement of the drilling mud and drill cuttings carried thereby from the bottom of the well where the mud is injected into the well about the drill bit to the surface of the well. Indicator means indicate to well personnel when drill cuttings from a desired preselected well depth are arriving at the surface of the well and that a sample of such cuttings should then be collected. In a preferred embodiment, the system includes a reset switch so that the indicator indicating that a sample should be collected remains on to continually remind the well personnel that a sample should be taken until the reset switch is activated upon collection of the sample. A timer keeps track of the time between activation of the indicator and activation of the reset switch so that the performance of sample collection personnel may be monitored. Additionally, adjustments may be made, if necessary, in evaluating and recording the results of such evaluation if an unacceptably long interval is apparent. Further, it is desireable to include a printer which automatically prints a sample label to be attached to the sample container indicating the depth from which the sample originated. The system can be set to indicate collection times for any desired depth intervals, such as to indicate sample collection times for samples representing each ten feet of well penetration or each thirty feet of well penetration.

In tracking the movement of the mud and drill cuttings from the bottom of the well to the surface, the system keeps track of the depth of the well and the volume of drilling fluid being pumped down the well. From these variables, the system calculates the expected travel of mud up the well.

THE DRAWINGS

In the drawings, which illustrate the best mode presently contemplated for carrying out the invention in actual practice:

FIG. 1 is a block diagram showing a basic system of the invention;

FIG. 2, a schematic diagram of a preferred embodiment of the apparatus of the invention;

FIG. 3, a typical monitor display that may be obtained using the apparatus of FIG. 2; and FIG. 4, a typical printout of sample collection data produced by the apparatus of FIG. 2.

DETAILED DESCRIPTION OF THE ILLUSTRATED EMBODIMENT

In well drilling operations such as in the drilling of oil wells, as previously indicated, drilling fluid, generally referred to as a drilling mud, is pumped during drilling operations down through the drill stem and into the region at the bottom of the well around the drill bit. This fluid, while lubricating the drill bit, picks up the drill cuttings cut by the drill bit along with formation gas released by the drilling and is pushed to the surface of the well with the drill cuttings and formation gases entrained therein by the additional mud being pumped down the well. The upward flow of drilling mud is through the well bore outside the drill stem.

Figure 1:
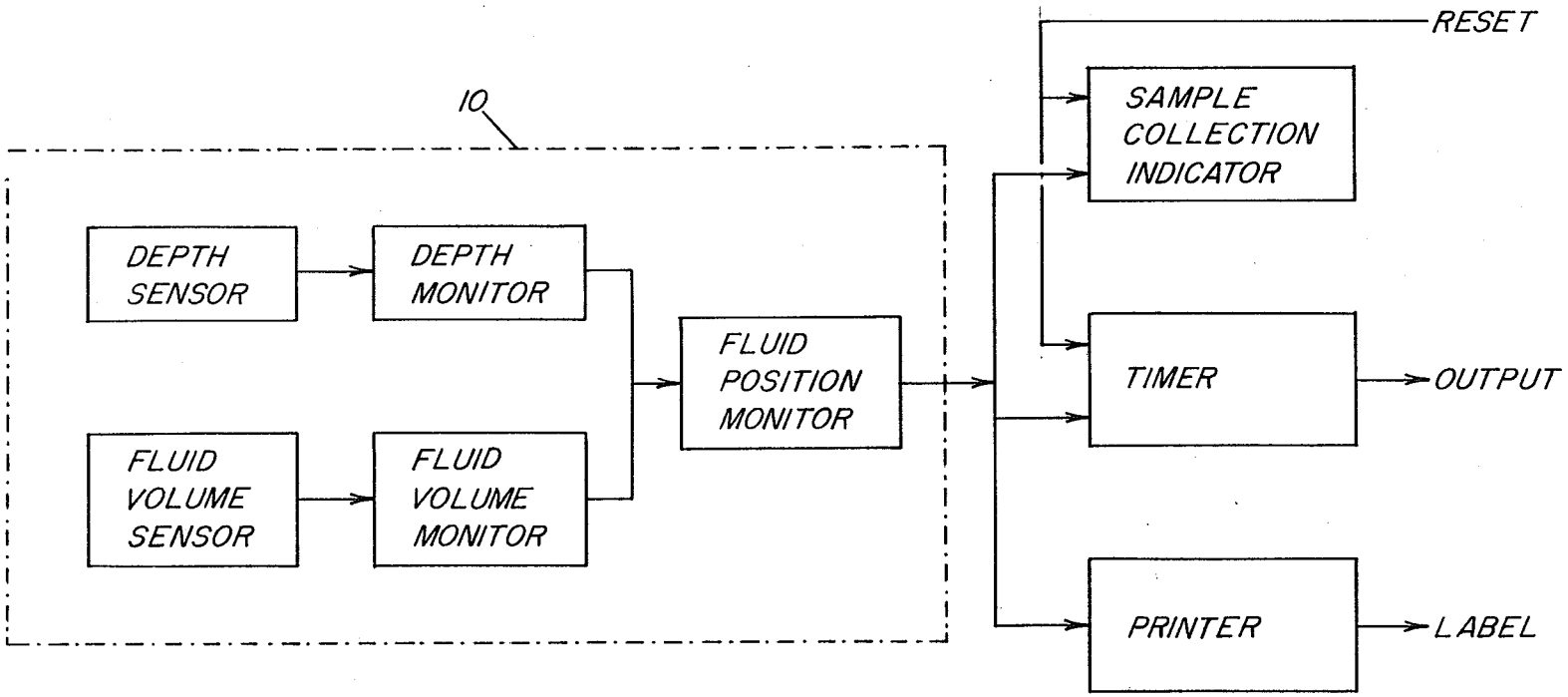

FIG. 1 is a block diagram showing a basic embodiment of the invention. A tracking means 10 keeps track of the drilling mud as it moves from the bottom of the well at a known depth to the surface of the well. The drill cuttings and gas released at the bottom of the well and entrained in the mud at the bottom of the well remain with the mud as it moves upwardly to the surface of the well. Therefore, by tracking the mud as it moves upwardly in the well, the depth at which the mud reaching the surface of the well at any time was injected into the well is known and therefore the origination depth of the drill cuttings and gas entrained in the mud is also known. The tracking means produces a signal indicative of the depth at which the mud reaching the surface of the well was introduced into the well and compares this with preselected depths at which samples are desired to be collected. When the mud reaching the surface of the well corresponds to a preselected desired sample depth, a signal is provided to activate the sample collection indicator which indicates to well personnel, usually through an audible alarm such as a bell, horn, or buzzer, that a sample should be collected and that such sample represents material collected at a desired preselected sample depth or preselected depth interval.

Since upward travel of the mud in the well from the bottom of the well where it is injected into the well about the drill bit to the surface of the well is caused by additional injection of drilling mud about the drill bit, the rate of flow of mud up the well is proportional to the amount or volume of mud pumped down the well. It is also proportional to the volume of the well bore outside the drill stem through which it flows upwardly, which volume is proportional to the depth of the well. The depth of the well is measured during drilling of the well. The area of the well bore outside the drill stem can be calculated and knowing the depth of the well, the volume of the well through which the mud flows can be calculated. The volume of mud pumped down the well can be measured and the volume of mud in the drill stem calculated. Thus, by measuring the depth of the well and the volume of mud pumped down the well, and knowing the area of the well bore and the area of the drill stem bore, the upward travel of the mud entering the well at the bottom of the well about the drill bit can be tracked until it reaches the surface of the well.

In the embodiment of FIG. 1, the tracking means 10 includes a depth sensor. This will usually take the form of the geolograph normally provided on the drilling rig which produces a signal for each foot the well is drilled. The signals from the geolograph are sent to a depth monitor which counts the signals from the geolograph to determine the depth of the well. A signal representative of the depth of the well is sent to the fluid position monitor.

The tracking means 10 also includes a fluid volume sensor which senses the volume of mud being pumped down the well. While various types of sensors and sensing methods may be used to determine mud flow, because the volume of mud pumped with each stroke of the mud pump can be calculated and is then known, it has been found satisfactory to use a sensor which senses each stroke of the pump being used to pump the mud. Such a sensor may be a proximity switch or microswitch located on the pump to be actuated at the end of each pump stroke. The signal indicating pump strokes and, where more than one pump may be used, the particular pump being used, is sent to the fluid volume monitor which produces an output signal indicative of the volume of mud pumped down the well. This signal is also sent to the fluid position monitor.

The fluid position monitor keeps track of the well depth and the volume of mud pumped down the well and from that information determines for the mud reaching the surface of the well at any time the depth at which such mud was injected into the well. It also determines if the sample reaching the top of the well is from a preselected depth for which a physical sample of drill cuttings from the well should be collected, and if so, provides a signal to the sample collection indicator.

Where the mud reaching the surface of the well is tested for various other properties or where the gas from the mud reaching the surface is collected and tested, the fluid position monitor provides signals indicative of the depth from which the mud has come so that the gas data or other test data is correlated to the proper well depth.

The depth monitor, fluid volume monitor, and fluid position monitor may advantageously take the form of a computer programmed to carry out the respective functions described. Thus, the computer is programmed to receive signals from the geolograph and to count such signals to keep track of the well depth. The computer is also programmed to receive signals from respective pumps for pumping the drilling mud and to know the volume of fluid pumped down the well for each stroke of each of the pumps that could be used. The computer is also programmed to take the depth information and the volume information and combine that with information preprogrammed into it regarding the diameter of the well bore and the diameter of the drill stem to determine the total volume of the drill stem and the total volume of the well bore outside the drill stem at the indicated depth and to calculate the volume of fluid that has to be pumped into the well to move the fluid at the bottom of the well to the surface of the well. Such calculation also takes into account the additional volume added to the well as drilling continues since the mud pumped down the well will have to fill that additional volume as well as displace mud already in the well. The results of these calculations may be indicated in terms of the number of strokes of the operating pump needed to move the mud to the surface. The pump strokes are then counted to determine when the sample reaches the surface. The capacity of the computer is preferably such that the originating depth of the mud reaching the surface of the well with each stroke of the pump is known. The computer can then compare this depth information for mud reaching the surface with each stroke with preselected depths that have been entered into the program as depths at which physical samples should be collected. Usually these preselected depths will be indicated as every ten feet, every thirty feet, or any other desired interval. When the actual depth calculated corresponds to a preselected depth, the sample collection indicator is activated.

The activation of the sample collection indicator to indicate to well personnel when a sample should be collected is all that is necessary in the basic system of the invention. However, it is advantageous to provide a reset switch adjacent the sample collection area or even as part of the sample collection apparatus so that it is operated to reset the indicator upon the actual taking of the sample and to provide a timer to measure the time between activation of the sample collection indicator and operation of the reset switch which should be approximately equal to the time delay between when the sample should have been taken and the time it is actually taken. In most instances, the actual taking of the sample will involve straining drill cuttings from the drilling mud reaching the surface and placing the drill cuttings obtained into a sample container. In normal practice, a bucket or other container is positioned with respect to a strainer to continually catch a sample of drill cuttings strained from the mud as it is taken from the surface of the well. These drill cuttings continually flow into the sample container and gradually fill it. If the sample collecting container is not emptied periodically, it will fill up and overflow, not collecting any of the cuttings which overflow and not providing a sample representative of the overflowed cuttings. In most cases, upon collection of the sample by well personnel, the cuttings are emptied by such personnel from the collecting container and placed in a separate sample container. This should be done at preset intervals determined by the well depth. The sample placed in the separate sample container then represents drill cuttings taken between the collection times and represents cuttings taken over the range of depths represented by the mud reaching the surface during that interval. Collection of samples is usually set to occur at predetermined depth intervals such as every ten feet or every thirty feet of well penetration. Thus, if a sample is transferred from the collection bucket and the bucket emptied when mud from a depth of 2500 feet is at the surface, the bucket is then replaced and begins collecting a new sample. If the desired sample intervals are ten feet of depth, the fluid position monitor sounds the sample collection indicator when mud from 2510 feet reaches the surface so that the sample is transferred from the collecting bucket to the sample container and collection of a new sample begins. If the desired sample interval is thirty feet, the fluid position monitor would wait to sound the collection indicator until mud from 2530 feet was at the surface. In this way, each sample collected is representative of the drill cuttings cut over the chosen depth interval. Measuring the time delay involved in collecting the sample monitors the performance of the well personnel taking the sample and indicates the accuracy of the sample. Also, if the time delay is longer than a preselected limit which may be programmed into the computer, the computer may be programmed to provide an indication of this time in some manner or to recalculate the actual depth interval of the well represented by the sample actually collected. When the reset switch is activated, it sends a signal to the fluid position monitor to reset the sample collection indicator and sends a signal to the timer to indicate the time delay and reset the timer. The timer may conveniently also be included as part of the computer in which case the computer is programmed to determine the time delay and then store the indication of the time delay for later use. The computer could also be programmed to take specific action based upon the amount of time delay occuring, or if the time delay exceeded some predetermined limit.

In a preferred embodiment of the invention, a label printer is provided in the sample collection area and the computer is programmed to cause operation of the label printer to print a label for each sample container. The label is preferably dispensed at the sample collecting site and is immediately available to well personnel when the sample is collected so that the label merely has to be stuck onto or otherwise secured in a simple manner to the sample container to identify the particular sample collected. The label may have nothing more thereon than an indication of well depth represented by the sample, or may have additional information such as time and date as desired.

Figure 2:
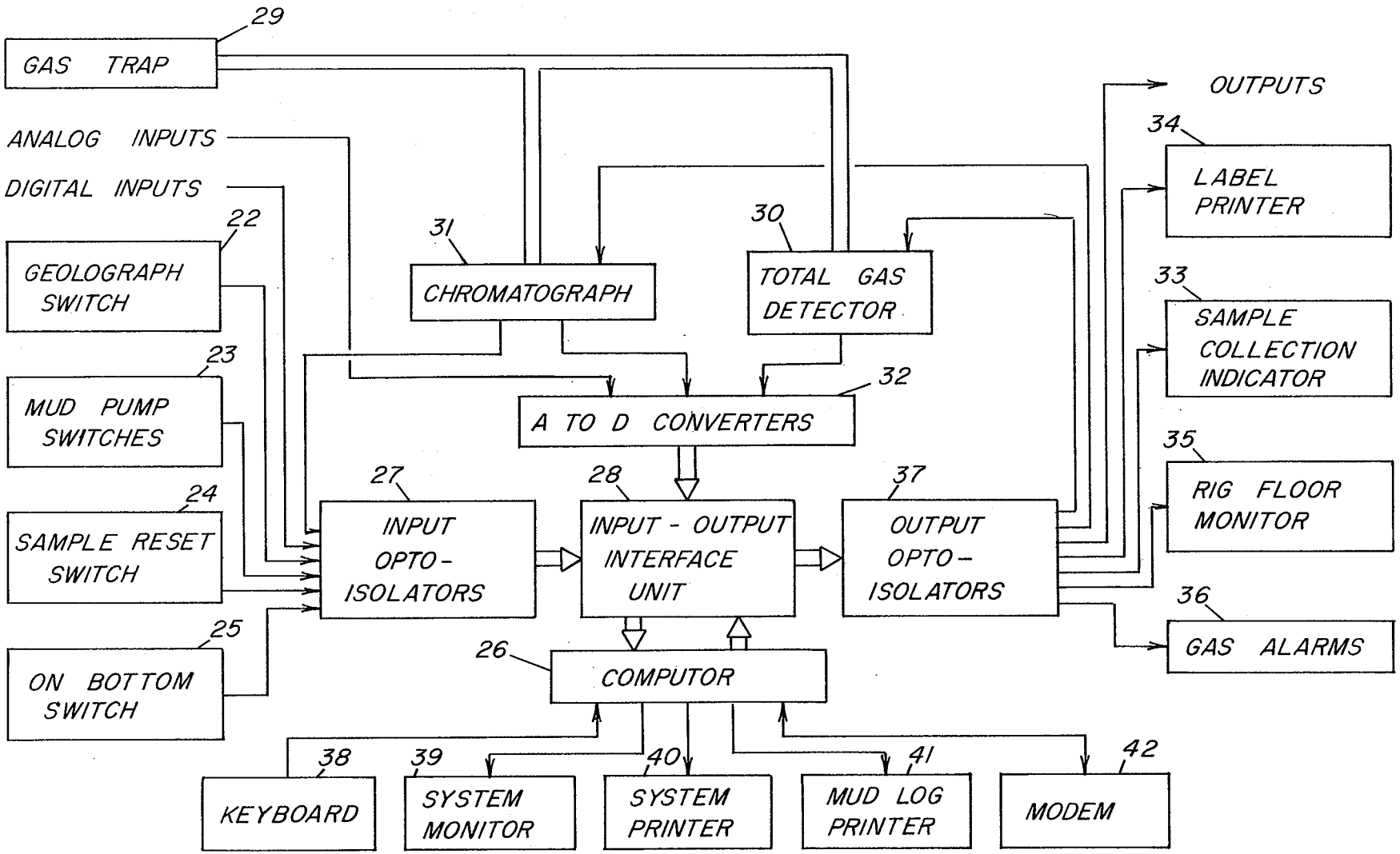

A preferred system of the invention is shown schematically in FIG. 2. As shown, various input devices such as the geolograph switch 22, mud pump switches 23, sample collection indicator reset switch 24, and "on bottom" switch 25 are coupled to computer 26 through an opto-isolator unit 27 and the input portion of an input-output interface unit 28. While various computers and interface units may be used, when a Leading Edge Model D computer or other IBM compatible or an IBM PC is used, an interface unit such as an Intel 8255 integrated circuit bidirectional programmable peripheral interface has been found satisfactory. Such an interface unit provides various input ports for switches, various output ports for a variety of peripheral equipment and input and output ports for digital data. The function of the geolograph switch 22, mud pump switches 23, and sample collection indicator reset switch 24 have been indicated previously. The "on bottom" switch is used to indicate that drilling has stopped and tells the computer to disable the geolograph switch so that any signals received during such period from the geolograph switch are not included or counted as indications that additional feet of well have been drilled.

Additional inputs may be provided depending upon additional features of the system. For example, in many cases it will be desirable to monitor certain properties of the mud or to measure gases released from the mud reaching the surface and to store the results of such measurements along with an indication of the depth of the well associated with such measurements. In order to provide gas sample information, the usual gas trap 29 may be used to collect the gases released from the mud as it reaches the surface. The collected gases are handled in standard manner with gas pumps and dilution valves as necessary and sent to standard gas detection and measuring equipment. This equipment, usually manually operated but adaptable to automatic computer control, will generally be arranged to measure total gas content of the mud and the concentration of five selected component gases. These are normally methane, ethane, propane, butane and iso-butane. The gas detector equipment, normally separate units 30 for measuring total gas and 31 for measuring specific concentrations, generally provide analog output signals indicative of gas measured. These analog signals are input signals to a standard analog to digital (A to D) converter 32 which converts the analog signals to digital signals and supplies them to the computer through the data input portion of the input-output interface unit 28. Interface electronics between the analog equipment outputs and the A to D converter may be necessary. Since the equipment 31 measuring the concentration of the individual components of gas detected generally works on a periodic basis rather than a continuous basis as does the total gas detection unit 30, an input signal to indicate when data from gas detection unit 31 is being transmitted is supplied as additional inputs to the computer through opto-isolator 27 and interface unit 28. Additionally, any other desired input information could be supplied to the computer as additional inputs or as additional data inputs.

There are also various output devices associated with the system. As previously indicated, a sample collection indicator 33 is provided so that when the computer determines that a sample should be collected, it activates the indicator to alert rig personnel that a sample should be collected. A label printer 34 is also provided. In the system of FIG. 2, in addition to the sample collection indicator and label printer, a rig floor monitor, such as a cathode ray tube (CRT) display unit 35, may be provided to display desired information on an ongoing basis to rig personnel. Such displayed information may include well depth, penetration rate, samples in transit from the bottom of the well, pump stokes left before the next sample is collected, or any other desired information. If gas content of the mud is being monitored by the system, a gas alarm 36 may also be provided to warn rig personnel of a dangerous increase in the gas content of the mud. The signals from the computer to operate the various output devices are sent to the devices from the computer through the output portion of the input-output interface unit 28 and an output opto-isolator unit 37. The sample collection indicator, label printer, rig floor monitor, and gas alarm, if provided, may all be conveniently housed together in a rig floor console located on the rig floor in the sample collection area.

Since many of the currently available gas detection equipment units require different measurement techniques at high and low gas concentrations and require varying levels of dilution gas at different gas concentration levels, output signals may be provided from the computer through interface unit 28 and optoisolator 37 to the gas detection equipment to operate it as necessary.

Additional outputs may also be provided as desired, for example, to operate remote monitors, remote printers, or to operate other desired output devices, indicators, or alarms.

In addition to the input and output devices connected to the computer through the input-output interface unit 28 as described, several input and output devices may be connected directly to the computer unit. Thus, as shown in FIG. 2, a keyboard 38 for manual entry of information or instructions to the computer is provided as is a monitor 39 for display of information inputed by the keyboard and display of output information from the computer. A printer 40 is provided to print desired reports and a special printer or plotter 41 may be provided for printing of information in special formats such as a plotter capable of printing the usual hand drawn mud logs. A modem 42 may also be provided so that the computer may receive instruction and transmit information to remote terminals or other remote computers via telephone lines.

The programming required by the computer will vary depending upon the specific computer used and the specific input and output devices used, but such programming will be a routine task based upon the above and following description of the operation of the system.

Figures 3, 4:
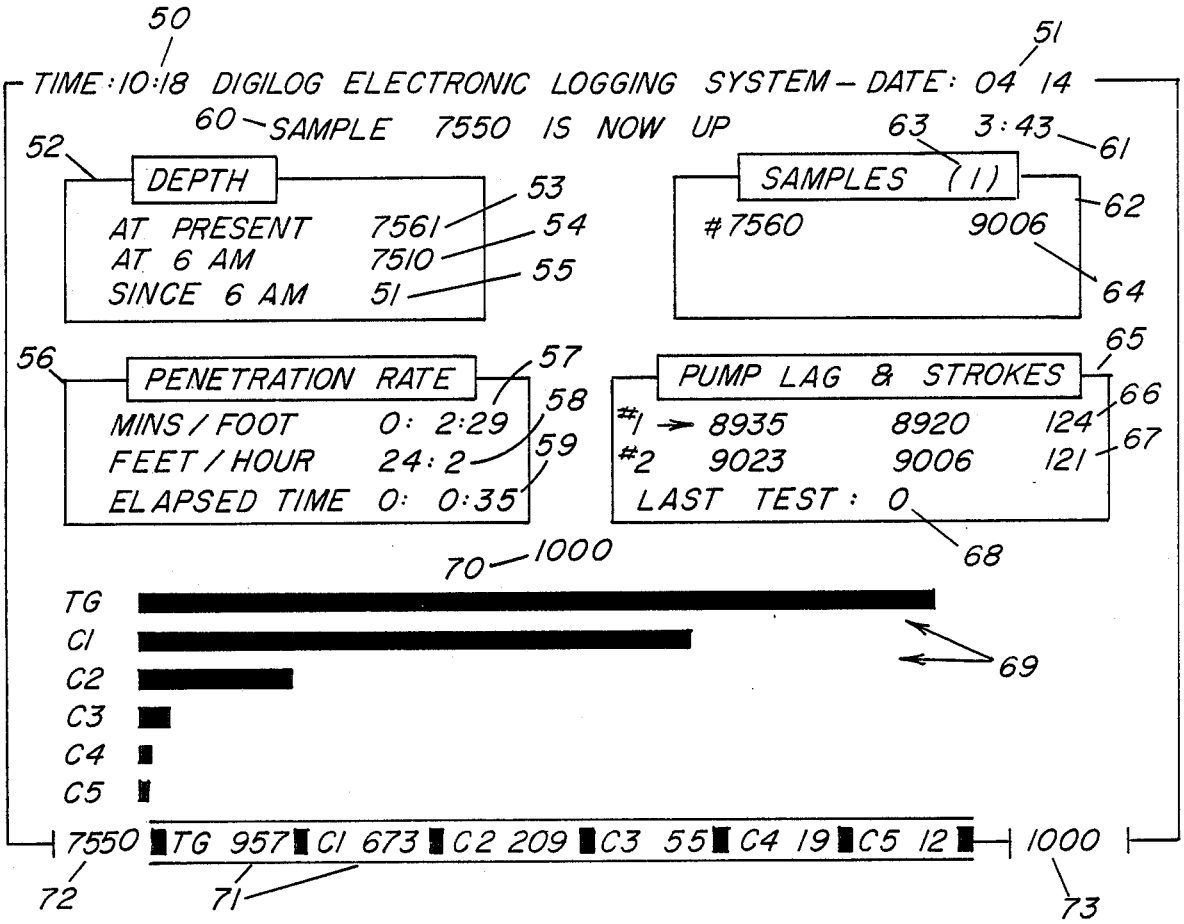

While various information can be provided on the computer monitor 39, the rig floor monitor 35, and various other remote monitors, if provided, and while the information provided will depend to some extent upon the information collected and processed by the computer, an example of a monitor display that can be provided by the system of FIG. 2 is shown in FIG. 3. The monitor display may have the current time 50 and current date 51 indicated thereon and an area 52 for displaying depth information. In the area 52 is shown the present depth 53, indicated as 7,561 feet, the depth 54 at 6:00 a.m., indicated as 7,510 feet, and the feet drilled since 6:00 a.m., 55, indicated as 51 feet, i.e., the difference between the current depth of 7,561 feet and the depth of 7,510 feet at 6:00 a.m. An area 56 may be provided to display the penetration rate as calculated by the computer from the depth and time information. Thus, for each foot of depth drilled the computer can calculate the time that it took to drill that foot and, based on that time, calculate the penetration rate. The time required to drill the last foot is determined by the computer and displayed at 57 indicating that it took two minutes and twenty-nine seconds. At this rate, 24.2 feet would be drilled in an hour as indicated at 58. The display also shows at 59 that drilling on the current foot, the 7,562th foot, has been going on for thirty-five seconds. The designated sample, 7,550, that has reached the surface is shown at the top of the display at 60. This indicates that mud from the depth of 7,550 feet has reached the surface and the sample representing that depth should have been collected. The number 3:43 shown at 61 in line with the indication of the current sample up indicates that the mud from the 7,550 depth reached the surface three minutes and forty-three seconds ago. The designated samples on their way up the well are indicated in area 62. The "1" at 63 indicates one sample is on its way up the well. The display shows at 64 that the mud injected into the well at 7,560 feet is on its way up the well and that it should reach the surface in 9,006 more pump strokes. The display only shows samples corresponding to the desired collection depths in progress up the well. Where a sample is taken every ten feet, only the successive ten foot depths will be shown in the sample area on the display. This means that the mud currently reaching the surface with each pump stroke was injected into the well during drilling of the ten feet between the depth of 7,550 feet which mud has reached the surface and 7,560 feet which has not yet reached the surface. If desired, samples from every foot or any other desired interval could be shown.

The pump lag and stroke information is shown in the area of the display indicated as 65. The particular pump in operation is indicated in some manner, such as with an arrow at the beginning of the line or by showing the line in reverse video, i.e., light letters on dark background. Here pump No. 1, i.e., the line indicated by reference number 66, is indicated with an arrow. The first number on that line following the pump number shows the present number of strokes of that pump required to raise the mud being injected into the well at the bottom of the well to the surface of the well. Here that is indicated as 8,935 strokes. The second number indicates the number of strokes remaining to bring the first sample listed in area 60 to the surface, here 8,920 strokes, and the last number indicates the strokes per minute of pump No. 1, here 124 strokes per minute. From this it can be estimated that it will take about seventy-two minutes for the mud from the 7,560 depth to reach the surface at which time the next sample should be collected. Such sample will then represent drill cuttings cut between 7,550 and 7,560 feet.

Similar information is listed on the line indicated as 67 for pump No. 2 with total strokes of that pump required to raise the mud currently injected into the bottom of the well shown as 9,023, and indicating that if that pump was currently in operation, as opposed to pump No. 1, 9,006 strokes would remain to raise the mud from the 7,560 depth to the surface. The last number in that line indicates that pump No. 2 is normally operated at a speed of 121 strokes per minutes. The last test indicator at 68 shows the depth of the well when the last manual determination of lag was conducted. Eventhough the computer can accurately calculate the lag based upon the volumes involved, sometimes the sides of a well can wash out or cave in which increases the volume of the well through which the mud flows and thereby affects the volume of mud needed to be pumped into the well to raise the mud to the surface of the well. Therefore, even with the present system, it is recommended that manual tests of the lag be conducted occasionally to ensure the accuracy of the system. When drilling in areas known to cave in or wash out easily, more frequent manual tests are recommended. The manual test involves placing a marker such as carbide or colored rope material into the mud entering the drill stem. The system then tracks this marker, calculating when the marker would be injected about the drill bit into the bottom of the well and then tracking the marker on its trip up. If the marker does not appear at the surface when the systems3 calculation says it should, the system is adjusted for the number of additional pump strokes necessary until the marker actually does appear. With a system which includes gas identification and measurement equipment, the marker may conveniently be a pack of carbide granules in a material which dissolves in the drilling mud. The pack is placed in the mud and the material gradually dissolves releasing the carbide into the mud. The carbide reacts with the mud to produce acetylene which is detected in the mud reaching the surface as propane. Thus, when the gas detection equipment detects a sudden increase in propane, it indicates that the carbide marker has reached the surface. In this case, the monitor indicates by the zero at 68 that no manual tests of lag have been made to check the system.

The manual test of the system of the present invention provides a much more accurate indication of lag than does the normal manual test which merely times the travel of the marker through the well. This is because with the present system the marker travel is accurately measured in terms of pump strokes and volume of mud pumped into the well which compensates for pump speed, well drilling stoppage, or different pumps being used. Thus, the manual test is tracked by the system so lag is accurately measured and is accurately applied to further determinations of lag as calculated by the system.

Where gas measurements are performed by the system, the monitor may also display the results of such gas measurements. As shown, a bar graph is provided in the lower portion of the display as indicated at 69 to graphically show total gas detected, indicated as TG and the concentration of the five constituent gases usually measured indicated as C1 through C5. The scale of the graphs is indicated by the number at 70. Here 1000 units is indicated as full scale for the graphs. The unit values of the gas detected and shown graphically are indicated at the bottom of the display in the line indicated as 71 along with the depth for which the measurements were taken indicated at 72 as 7,550 feet. Where total gas is measured by the system, it is preferred to include a gas alarm to alert well personnel if the gas level in the mud reaches a dangerous level. The number 1000 shown at 73 indicates that the gas alarm is set to go off if total gas detected reaches 1000 units. While a particular embodiment of monitor display has been shown, more or less information as desired by the user, can be included and various formats may be used.

An advantage the system of the invention has wherein a computer is used to store information obtained by the system is that such information may be displayed or printed out when desired and in any format desired. FIG. 4 shows a report that can be produced by the system indicating various samples that have reached the surface of the well, when the samples reached the surface, and the time lapse between the indicated collection times and the actual collection times. The first line of the report under the date indicates that the sample representing the depth of 12,510 feet reached the surface of the well and the sample collection indicator was activated at 16:56 or 4:56 p.m. The reset switch was activated one minute and seventeen seconds later which should mean that the sample for 12,510 feet was actually collected within about one minute and seventeen seconds from the time collection was indicated. This represents a generally reasonable time for collection of a sample. The second line of the report indicates that the sample of 12,520 feet reached the surface at 17:35, i.e., 5:35 p.m., and was collected within fifty-seven seconds. The third line indicates that the sample for 12,530 feet reached the surface at 17:57, i.e., 5:57 p.m., but was not collected until three minutes and forty-two seconds later. The fourth line indicates that the sample for 12,540 feet reached the surface at 18:31, i.e., 6:31 p.m., but that it was not collected at all. Thus, if a sample shows up marked 12,540, it is known that the sample is not correctly marked and the sample for 12,550, although collected within about fifty-seven seconds of when it reached the surface also probably included the sample that should have been taken at 12,540 so the 12,550 sample actually represents drill cuttings collected for the depths between 12,530 and 12,550 as opposed to merely those between 12,540 and 12,550 as it should. Therefore, if such sample shows anything unusual or different from the samples before or after, this collection information can be taken into account in evaluating the information obtained from the actual samples.

While any type of sample collection indicator may be used with the system, the indicator should be chosen so that it will alert well personnel when a sample should be collected. Therefor, audible indicators such as horns or similar devices may be used. In order to give time to a person to travel to the collection area and collect the sample, it may be desirable to operate such indicator on an intermittent bases. Also, while the reset switch may be located in any desired location, since operation of the reset switch is suppose to indicate that a sample has actually been collected, the reset switch should be located with that in mind. Ideally, the reset switch could be associated with the sample collecting apparatus itself so the switch would be operated when the sample collection bucket was removed from its collecting position to be emptied into a sample container, and further activated when the bucket was replaced to ensure proper sample collection. However, merely placing a hand operated switch in the sample collection area so that it can be operated by a person preparing to take a sample has generally been found satisfactory.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. In a well drilling operation wherein a drilling fluid is pumped down the well to the bottom of the well during drilling of the well, wherein the fluid pumped down the well flows to the surface of the well carrying drill cuttings from the bottom of the well with it, and wherein well personnel are present at the well site during such drilling, an apparatus for determining when a sample of drill cuttings reaching the surface of the well should be collected to provide a sample of drill cuttings cut at a preselected desired well depth and for determining if and when the sample is actually collected, comprising means for tracking the movement of the drilling fluid and drill cuttings carried thereby from the bottom of the well at a preselected depth as they travel to the surface of the well; indicator means for indicating to well personnel that drill cuttings from a preselected well depth are arriving at the surface of the well and that a sample of such cuttings should be collected; reset means to be activated upon collection of the sample to reset the indicator means; and timer means to determine the time between activation of the indicator means and activation of the reset means to thereby indicate when the sample indicated as ready for collection is actually collected.

2. Apparatus for determining when a sample of drill cuttings should be collected according to claim 1, wherein the means for tracking the movement of the drilling fluid includes means for sensing the depth of the well; and means for sensing the volume of drilling fluid pumped down the well.

3. Apparatus for determining when a sample of drill cuttings should be collected according to claim 2, wherein the means for sensing the depth of the well produces electrical signals indicative of well depth, wherein the means for sensing the volume of drilling fluid pumped down the well produces electrical signals indicative of the volume of fluid pumped down the well, and wherein means responsive to the depth signals and the volume signals monitors the travel of the fluid up the well toward the surface of the well.

4. Apparatus for determining when a sample of drill cuttings should be collected according to claim 3, wherein the means for sensing the depth of the well includes a geolograph and wherein the means for sensing the volume of drilling fluid pumped down the well includes means monitoring the operation of the pumps pumping the drilling fluid.

5. Apparatus for determining when a sample of drill cuttings should be collected according to claim 4, wherein the means monitoring the operation of the pumps sense each stroke of an operating pump.

6. Apparatus for determining when a sample of drill cuttings should be collected according to claim 5, wherein the means responsive to the depth signals and to the volume signals for monitoring travel of the fluid is a computer programmed to calculate the travel of the fluid up the well.

7. Apparatus for determining when a sample of drill cuttings should be collected according to claim 1, wherein the indicator means includes an audible alarm.

8. Apparatus for determining when a sample of drill cuttings should be collected according to claim 1, wherein there is additionally included printer means to print a report indicating the delay time in collecting indicated samples.

9. Apparatus for determining when a sample of drill cuttings should be collected according to claim 1, additionally including printer means for printing a label for each sample collected indicating the depth of the well at which such sample originated.

10. Apparatus for determining when a sample of drill cuttings should be collected according to claim 1, additionally including means for determining the gas content of the mud, and means for drawing a mud log.

11. On a drilling rig where samples of drill cuttings are normally collected representing various depths of the well, and wherein well personnel are present on the rig, and wherein one or more special persons is employed to determine when samples should be taken and to collect samples, a method of eliminating the need for such special persons, comprising providing tracking apparatus to automatically track the depth from which drill cuttings reaching the surface of the well originated in the well; providing comparing apparatus and coupling such comparing apparatus to the tracking apparatus so that the comparing apparatus automatically compares preset depths at which samples are desired to be collected with the depth represented by the samples reaching the surface; providing indicator apparatus responsive to the comparing apparatus so that the indicator apparatus is automatically activated when the depth represented by a sample reaching the surface corresponds to a desired sample collecting depth to thereby alert well personnel that a sample should be collected and thereby eliminating the need for the special persons; and providing timing apparatus to determine the time between the indication that a sample should be collected and the time it is actually collected to thereby provide information as to the actual depths from which the sample collected originated.

12. A method according to claim 11, wherein the steps of providing the tracking apparatus, comparing apparatus, and timing apparatus includes the step of programming a computer to function as such apparatus.

13. A method according to claim 12, additionally including the step of providing apparatus to perform gas measurements on the mud reaching the surface, and of providing printer means, and wherein the computer is programmed to collect and print information regarding depth and corresponding gas information in the form of a mud log.

14. In a well drilling operation wherein a drilling fluid is pumped down the well to the bottom of the well during drilling of the well, wherein the fluid pumped down the well flows to the surface of the well carrying drill cuttings from the bottom of the well with it, and wherein well personnel are present at the well site during such drilling, a method of determining when a sample of drill cuttings reaching the surface of the well should be collected to provide a sample of drill cuttings cut at a preselected desired well depth, comprising monitoring the depth of the well; calculating the expected volume of the well through which drilling fluid and drill cuttings carried thereby will flow upwardly from the bottom of the well to the surface of the well at various sensed depths of the well; calculating the expected volume of the well bore through which drilling fluid will flow downwardly from the surface of the well to the bottom of the well at the same various sensed depths of the well; calculating the volume of drilling fluid necessary to pump down the well to cause the drilling fluid at the bottom of the well at particular sensed depths of the well to be displaced and reach the surface of the well; monitoring the volume of drilling fluid pumped down the well; calculating at what depth drilling fluid reaching the surface of the well would have been injected into the well; comparing the depth at which drilling fluid reaching the surface of the well would have been injected into the well with predetermined depths at which samples should be collected; activating an indicator means when the depth at which drilling fluid reaching the surface of the well would have been injected into the well coincides with one of the predetermined depths at which sample collection is desired; and locating the indicator means so that well personnel are alerted to the indication when the indicator means is activated and will collect a sample in response to activation of the indicator means.

15. A method according to claim 14, additionally including timing the time between activation of the indicator means and collection of the sample.

16. A method according o claim 15, additionally including printing a report indicating the time between activation of the indicator means and collection of the sample for the various sample collection times indicated. cuttings cut at a preselected desired well depth, comprising monitoring the depth of the well; calculating the expected volume of the well through which drilling fluid and drill cutting s carried thereby will flow upwardly from the bottom of the well to the surface of the well at various sensed depths of the well; calculated the expected volume of the well bore through which drilling fluid will flow downwardly from the surface of the well to the bottom of the well at the same various sensed depths of the well; calculating the volume of drilling fluid necessary to pump down the well to cause the drilling fluid at the bottom of the well at particular sensed depths of the well to be displaced and reach the surface of the well; monitoring the volume of drilling fluid pumped down the well; calculating at what depth drilling fluid reaching the surface of the well would have been injected into the well; comparing the depth at which drilling fluid reaching the surface of the well would have been injected into the well with predetermined depths at which samples should be collected; activating an indicator means when the depth at which drilling fluid reaching the surface of the well would have been injected into the well coincides with one of the predetermined depths at which sample collection is desired; and locating the indicator means so that well personnel are alerted to the indication when the indicator means is activated and will collect a sample in response to activation of the indicator means.

17. A method according to claim 14, wherein the drilling fluid is pumped down the well to the bottom of the well during drilling by one of two or more available positive displacement piston pumps each of which pumps a known but different volume of drilling fluid with each stroke of the pump and each of which pumps may be used at any time during drilling, and wherein the step of monitoring the volume of drilling fluid pumped down the well includes the steps of determining which pump is operating at any particular time, and counting the number of strokes of the operating pump.

18. In a well drilling operation wherein a drilling fluid is pumped down the well to the bottom of the well during drilling of the well, wherein the fluid pumped down the well flows to the surface of the well carrying drill cuttings from the bottom of the well with it, and wherein well personnel are present at the well site during such drilling, an apparatus for determining when a sample of drill cuttings reaching the surface of the well should be collected to provide a sample of drill cuttings cut at a preselected desired well depth, comprising means for sensing the depth of the well; means for calculating the expected volume of the well through which drilling fluid and drill cuttings carried thereby will flow upwardly from the bottom of the well to the surface of the well at various sensed depths of the well; means for calculating the expected volume of the well bore through which drilling fluid will flow downwardly from the surface of the well to the bottom of the well at the same various sensed depths of the well; means for calculating the volume of drilling fluid necessary to pump down the well to cause the drilling fluid at the bottom of the well at particular sensed depths of the well to be displaced and to reach the surface of the well; means for sensing the volume of drilling fluid being pumped down the well during drilling of the well; means for relating the calculation of the volume of drilling fluid necessary to pump down the well to cause the drilling fluid at the bottom of the well at particular sensed depths to be displaced and reach the surface of the well with the sensed volume of drilling fluid being pumped down the well to identify the depth at which drill cuttings reaching the surface of the well were cut; and indicator means for indicating to well personnel when drill cuttings from a preselected well depth are arriving at the surface of the well and that a sample of such cuttings should be collected.

19. Apparatus for determining when a sample of drill cuttings should be collected according to claim 18, wherein the drilling fluid is pumped down the well by a positive displacement piston pump which pumps a known volume of drilling fluid with each stroke of the pump, and wherein the means for sensing the volume of drilling fluid pumped down the well includes means to sense each stroke of the pump.

20. Apparatus for determining when a sample of drill cuttings should be collected according to claim 18, wherein the drilling fluid is pumped down the well by one of two or more available positive displacement piston pumps each of which pumps a known but different volume of drilling fluid with each stroke of the pump and each of which may be used at any particular time, and wherein the means for sensing the volume of drilling fluid pumped down the well includes means to sense which of the pumps is operating and to sense each stroke of the operating pump.

21. Apparatus for determining when a sample of drill cuttings should be collected according to claim 18, wherein the means for calculating the expected volume of the well, the means for calculating the expected volume of the well bore, the means for calculating the volume of drilling fluid and the means for relating the calculations is a computer programmed to perform as such means.

22. Apparatus for determining when a sample of drill cuttings should be collected according to claim 21, wherein the means for sensing the depth of the well includes apparatus for producing an electrical signal for each preselected increment of depth the well is drilled and the computer additionally programmed to count the number of electrical signals received as an indication of well depth and wherein the means for sensing the volume of drilling fluid being pumped down the well during drilling includes apparatus for producing an electrical signal for each preselected increment of volume of fluid pumped down the well and the computer additionally programmed to count the number of electrical signals received as an indication of volume of drilling fluid pumped down the well.

* * * * *